United States Patent [19]

Brandt

[11] Patent Number: 4,741,670

[45] Date of Patent: May 3, 1988

[54] PROPELLER COMBINATION FOR A BOAT PROPELLER UNIT

[75] Inventor: Lennart H. Brandt, Fjärås, Sweden

[73] Assignee: AB Volvo Penta, Goteborg, Sweden

[21] Appl. No.: 907,214

[22] Filed: Sep. 12, 1986

[30] Foreign Application Priority Data

Sep. 17, 1985 [SE] Sweden ..... 8504310

[51] Int. Cl.[4] ..... B63H 1/18

[52] U.S. Cl. ..... 416/129; 416/175; 416/242

[58] Field of Search ..... 416/129, 120, 124, 125, 416/128, 175 R, 203, 129 A, 242

[56] References Cited

U.S. PATENT DOCUMENTS

| | | | |
|---|---|---|---|
| 1,088,080 | 2/1914 | Leavitt | 416/129 A |
| 1,853,694 | 4/1932 | Melcher | 416/129 A |
| 2,672,115 | 3/1954 | Conover | 416/128 X |
| 3,109,495 | 11/1963 | Lang | 416/129 A X |
| 3,514,215 | 5/1970 | Williams | 416/203 X |
| 3,697,193 | 10/1972 | Phillips | 416/242 X |
| 4,073,601 | 2/1978 | Kress | 416/242 |
| 4,529,387 | 7/1985 | Brandt | 416/129 A X |
| 4,552,511 | 11/1985 | Sumigawa | 416/242 |
| 4,619,584 | 10/1986 | Brandt | 416/129 A |
| 4,642,059 | 2/1987 | Nohara | 416/129 A X |

FOREIGN PATENT DOCUMENTS

| | | | |
|---|---|---|---|
| 302859 | 1/1918 | Fed. Rep. of Germany | 416/242 |
| 908253 | 4/1946 | France | 416/128 |
| 369864 | 4/1939 | Italy | 416/128 |
| 96092 | 6/1984 | Japan | 416/129 A |
| 433599 | 6/1984 | Sweden . | |
| 435364 | 9/1984 | Sweden . | |
| 2094894 | 9/1982 | United Kingdom | 416/129 A |

*Primary Examiner*—Everette A. Powell, Jr.

*Attorney, Agent, or Firm*—Young & Thompson

[57] ABSTRACT

The invention relates to a boat propeller unit with double, counter-rotating propellers. The forward propeller is designed to function without cavitation, while the after-propeller is optimally cavitating by being made cupped and with a blade width of between 60% and 75% of the blade width of the forward propeller.

2 Claims, 2 Drawing Sheets

PROPELLER COMBINATION FOR A BOAT PROPELLER UNIT

Figure 1:
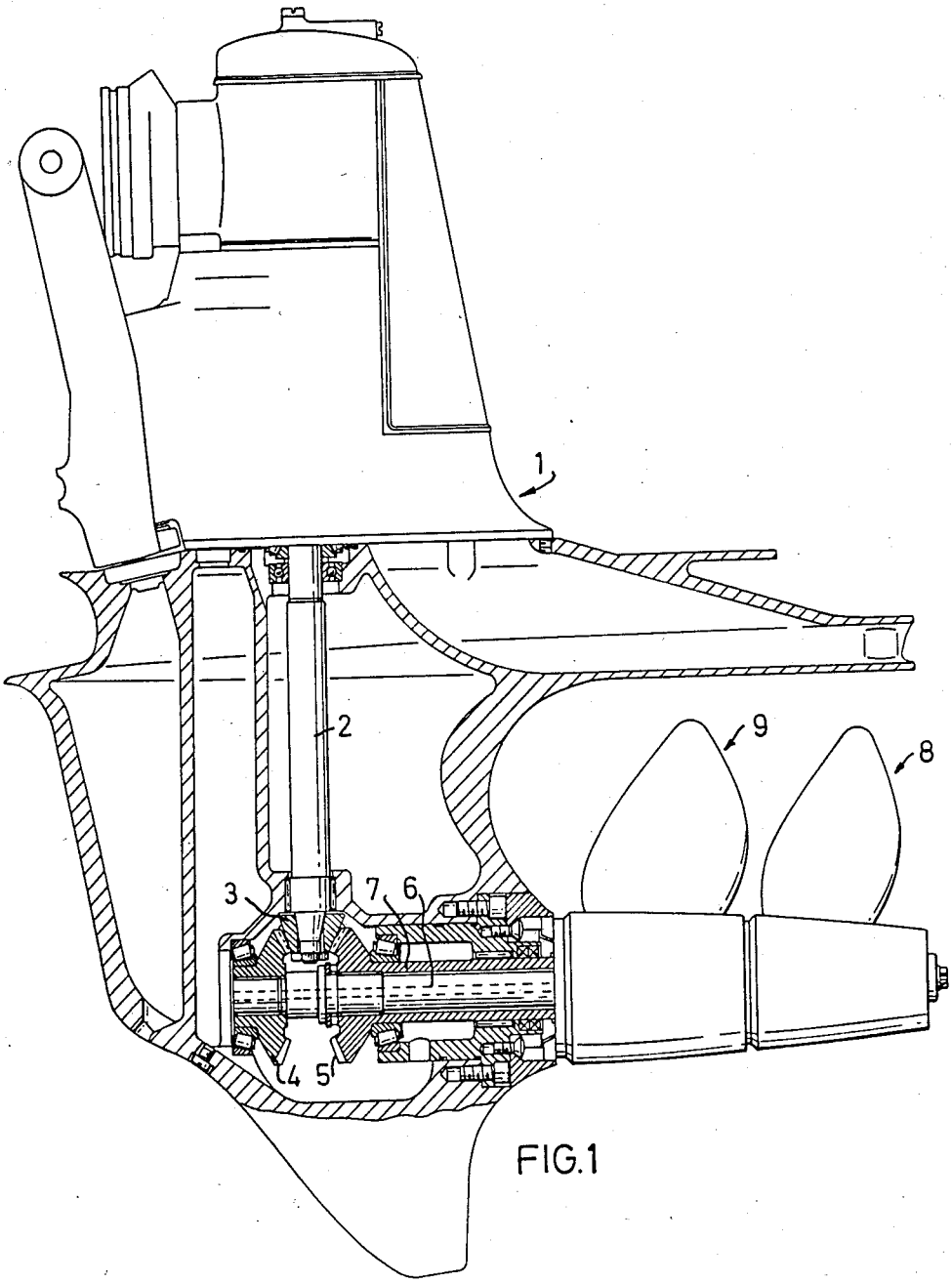

The present invention relates to a propeller combination for a boat propeller unit, comprising a forward propeller and an after-propeller intended to rotate in opposite directions about a common rotational axis.

Such a propeller combination is shown in U.S. Pat. No. 4,619,584, in which both the propellers are designed for optimum cavitation-free operation. This gives the propellers a "firm-grip" in the water which is an advantage for heavy boats, since the manoeuverability will be quite good and it provides good control of the boat's movement in the water.

If, however, the engine power is increased at the same time as a lighter boat is used for higher speeds, the effect of the propeller grip in the water affects the behaviour of the boat during sudden turns with extreme rotation of the steering wheel. For example for a fast boat (35–45 knots) with a deep V-bottom, the long, deep V will track the boat even in turns. If the steering wheel is turned sharply, the boat can be forced into such a sharp turn that the V will suddenly lose its grip and the after-portion skid. At precisely this moment when the skidding occurs, there arises a counter-acting force on the propeller transversely to the propeller in its plane of rotation. The water strives to counter-act the subsequent displacement of the propeller, the counter-acting forces being proportional both to the pull of the propeller and its displacement speed.

The suddenly arising (and short-lived) force makes the propeller "stick" in the water for an instant, and if the boat speed is quite high and one makes a hard, rapid turn of the wheel there is the risk that the boat will make a short outwardly directed tipping movement, which can be unexpected for those in the boat. This sudden phenomenon is not particularly connected with double propeller units but applies generally to non-cavitating propellers.

The purpose of the present invention is to achieve a propeller combination of the type described by way of introduction, by means of which it is possible to appreciably reduce the propeller transverse forces which can arise when skidding (especially in boats with a deep V-bottom) not only to increase safety but also to provide a softer, more comfortable movement when turning.

This is achieved according to the invention by the forward propeller being designed to function without cavitation, while the after-propeller is designed to function with optimum or partial cavitation, has cupped blades and a total blade area of between $\frac{1}{3}$ and $\frac{2}{3}$ of the total blade area of the forward propeller.

The following general principles apply to cavitation:

A propeller blade cuts through the water with a speed which is a combination of the boat speed and the rotational speed of the blade. At the representation radius of 70%, the velocity is normally 60–70 knots. The velocity is high and the blade must therefore be thin and long, so that the water will have time to fill up the cavity which tends to form when the blade cuts through the water. At 60 knots for example, the blade may have a thickness of at most 8% of the blade width and at 70 knots at most 6%.

In addition to the blade thickness, the water is affected by a pressure difference over the blades, corresponding to the pulling force of the propeller. This creates a suction side and a pressure side, to which pressure the effect of the blade thickness is added. The required blade area per kW of engine power can be calculated by known methods for a propeller which is to work optimally without cavitating. For the propeller drive unit described in U.S. Pat. No. 4,619,584 the target value is about 10 $cm^2$ per kW.

By dimensioning the after-propeller in accordance with the invention with "too little" area, a cavitating propeller is obtained. In order to make it practical to have such a propeller, it is essential, however, that the bubble not collapse on the blade. In accordance with an additional feature of the invention, the after-propeller is cupped, i.e. the blade is provided with a sharp curvature at the rear edge and this produces a pressure fluid which has a tendency to provide a low pressure which becomes lower from the nose to the rear edge. The result is that the cavitation bubble begins at or near the rear edge. It is also small.

The invention provides a propeller combination with an after-propeller, the efficiency of which is somewhat lower than for a conventional propeller, but which, on the other hand, makes it possible to reduce the steering forces by up to 50%.

The invention will be described below with reference to examples shown in the accompanying drawings.

Figure 2:
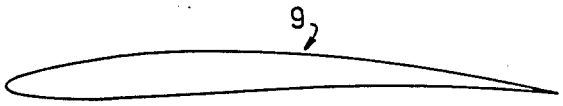
Figure 3:
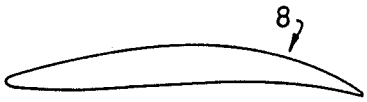

FIG. 1 shows in partial section a side view of a propeller combination according to the invention, FIG. 2 shows a cross section through a forward propeller blade, and FIG. 3 shows a cross section through an after-propeller blade.

The propeller drive unit generally designated 1 in FIG. 1 is a so-called inboard/outboard drive unit, designed to be mounted on a boat transom and be coupled to the output shaft of an engine (not shown). The drive unit contains a reversing mechanism, with an output shaft 2 having a conical gear 3 in constant engagement with two conical gears 4 and 5. Gear 4 drives one propeller shaft 6 and gear 5 drives a hollow shaft 7 journalled concentrically to shaft 6. Shaft 6 carries propeller 8 and shaft 7 carries propeller 9. This arrangement makes the propeller shafts rotate in opposite directions.

The forward propeller 9 shown in section in FIG. 2 is shaped so that the propeller will function without cavitation, while the after-propeller shown in section in FIG. 3 is shaped so that the propeller will have an optimum cavitation (semi-cavitating), the cavitation bubble extending from the rear edge of the propeller blade and not from its front edge. For this purpose the propeller 8 is made with a section, the chord of which in the example shown is reduced by about 30% in relation to the forward propeller 8. In order to provide optimum cavitation for the after-propeller the total blade area must be between $\frac{1}{3}$ and $\frac{2}{3}$ of the total blade area of the forward propeller.

As shown in FIG. 3, the blades of the after-propeller are cupped and have their maximum curvature in the rear half of the chord. The radius of curvature for the arch line at the forward edge (the forward 10% of the chord) is at least three times as long as that at the rear edge (the rear 10% of the chord). The thickness is increased about 14% in relation to the forward propeller so as not to reduce the strength of the blade due to the reduced blade width.

Tests and analyses have demonstrated that the forward propeller 9 should have three blades (possibly four blades) and be non-cavitating (i.e. have conventional shape) and that the after-propeller 8 in order to cavitate optimally should have a blade width of between 60% and 75% of the width of the forward propeller and preferably have the same number of blades as the forward propeller. The optimum diameter will then be 4–6% less due to the blade shape, and an additional 5–10% less due to the increased flow-through speed caused by the forward propeller. This agrees exactly with the diameter desired in order to lie just within the flow tube from the forward propeller. One blade less would tend to result in a propeller with too large a diameter. When using an after-propeller with one blade more, i.e. a four-bladed propeller, the diameter of the after-propeller should be between 75% and 95% of the diameter of the forward propeller and its pitch ratio (pitch/diameter) should be between 1.1 and 1.3 times that of the forward propeller.

I claim:

1. Propeller combination for a boat propeller unit comprising a forward propeller and an after-propeller that rotate in opposite directions about a common rotational axis, characterized in that the forward propeller is so shaped as to function without cavitating while the after-propeller is so shaped as to function with optimum cavitation and has cupped blades and a total blade area of between $\frac{1}{3}$ and $\frac{2}{3}$ of the total blade area of the forward propeller, the blades of the after-propeller having a mean camber line whose maximum curvature is in its rear half, the blade width of the after-propeller being between 60% and 75% of the blade width of the forward propeller and the propellers having the same number of blades.

2. Propeller combination as claimed in claim 1, in which the radius of curvature of the mean camber line at the front portion of the blades of the after-propeller is at least three times longer than at the rear portion of the blades of the after-propeller.

* * * * *